US011340025B2

(12) United States Patent
Pstragowski

(10) Patent No.: US 11,340,025 B2
(45) Date of Patent: May 24, 2022

(54) HEAT TRANSMISSION ROLL FOR A ROTARY CYLINDRICAL HEAT EXCHANGER

(71) Applicant: SWISS ROTORS SPÓŁKA Z OGRANICZONĄ ODPOWIEDZIALNOŚCĄ, Gdynia (PL)

(72) Inventor: Józef Pstragowski, Pogórze (PL)

(73) Assignee: SWISS ROTORS Spolka z o.o., Gdynia (PL)

( * ) Notice: Subject to any disclaimer, the term of this patent is extended or adjusted under 35 U.S.C. 154(b) by 15 days.

(21) Appl. No.: 16/765,864

(22) PCT Filed: Nov. 30, 2018

(86) PCT No.: PCT/PL2018/000122
§ 371 (c)(1),
(2) Date: May 20, 2020

(87) PCT Pub. No.: WO2019/112454
PCT Pub. Date: Jun. 13, 2019

(65) Prior Publication Data

US 2020/0363137 A1 Nov. 19, 2020

(30) Foreign Application Priority Data

Dec. 4, 2017 (PL) ..... 423707

(51) Int. Cl.
*F23L 15/02* (2006.01)
*F28D 19/04* (2006.01)
*F28F 3/02* (2006.01)

(52) U.S. Cl.
CPC ..... *F28D 19/042* (2013.01); *F28F 3/025* (2013.01)

(58) Field of Classification Search
CPC ..... F28F 3/025; F28D 19/042
USPC ..... 165/8
See application file for complete search history.

(56) References Cited

U.S. PATENT DOCUMENTS 5,085,268 A * 2/1992 Nilsson ..... B21D 53/027 156/184
5,157,010 A 10/1992 Maus et al.
5,318,102 A * 6/1994 Spokoyny ..... F28D 19/042 165/10

(Continued)

FOREIGN PATENT DOCUMENTS

EP 0052592 A2 5/1982
EP 0136515 B1 11/1987

(Continued)

*Primary Examiner* — Claire E Rojohn, III
(74) *Attorney, Agent, or Firm* — Andrzej Malarz, Esq.

(57) ABSTRACT

The heat transmission roll for a rotary cylindrical heat exchanger comprising layers formed by two superposed strips wound around the core, where the first strip (1) is corrugated transversely to form regular waves with wave crests (3) on the one side of the strip, and wave troughs (4) on the other side of the strip (4), while the second strip (2) is basically flat. Formed on all wave crests (3) of the first strip (1) are bulges (5) featuring slits (6), where one of the slit edges is formed into a tongue (7), while the second strip (2) features separate indentations (8) to accommodate the bulges (5) on the first strip (1), where the depth of the indentation corresponds to the pitch (h) of the bulge.

6 Claims, 4 Drawing Sheets

(56) References Cited

U.S. PATENT DOCUMENTS

Figure 1:
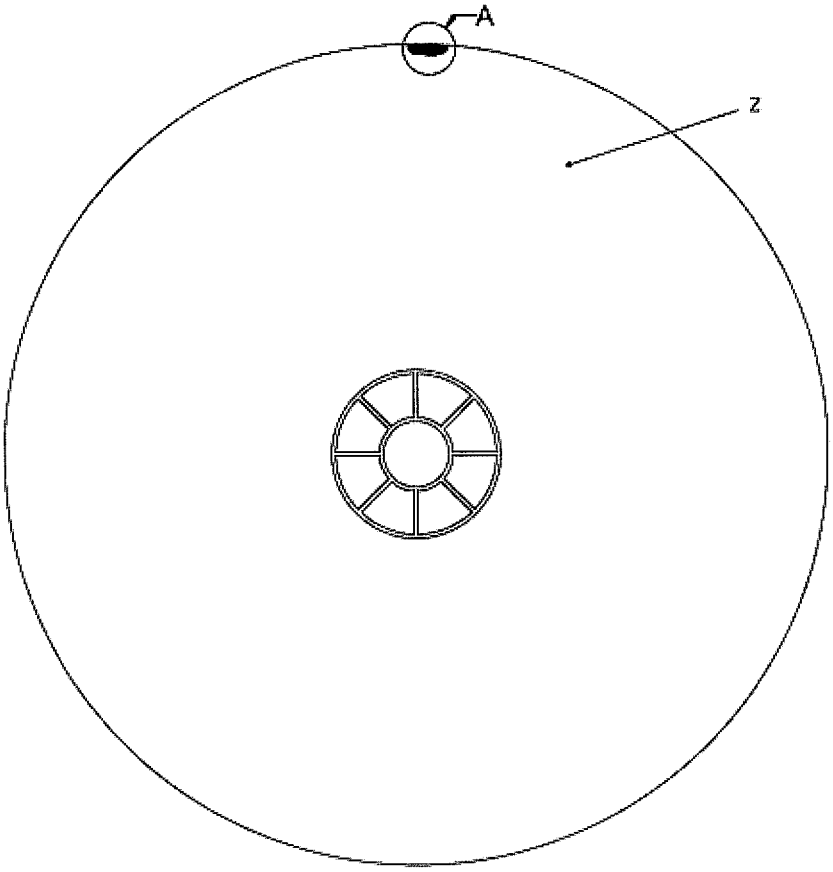
Figure 1:
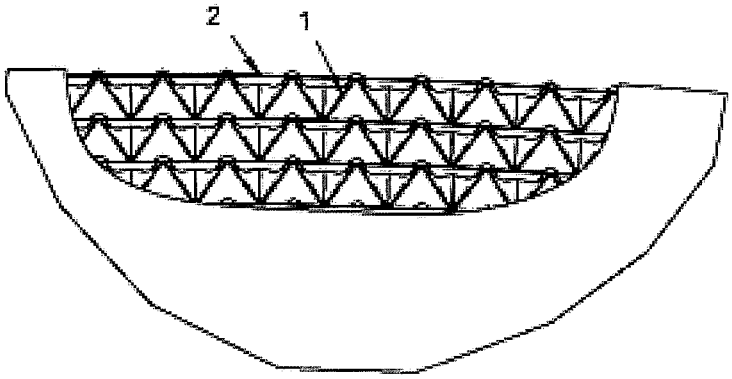

| | | | | |
|---|---|---|---|---|
| 5,323,842 | A * | 6/1994 | Spokoyny | F28D 20/02 165/7 |
| 8,296,946 | B2 * | 10/2012 | Wieres | F01N 3/2821 29/890 |
| 8,444,741 | B2 * | 5/2013 | Bruck | F01N 3/281 55/523 |
| 8,622,115 | B2 * | 1/2014 | Seebald | F28D 19/044 165/8 |
| 10,175,006 | B2 * | 1/2019 | Seebald | F28F 3/046 |
| 10,197,337 | B2 * | 2/2019 | Birmingham | F28D 19/00 |
| 10,378,829 | B2 * | 8/2019 | O'Boyle | F28D 19/042 |
| 2005/0274012 | A1 * | 12/2005 | Hodgson | B21D 13/04 29/890 |
| 2006/0048921 | A1 * | 3/2006 | Usui | F28F 3/027 165/109.1 |
| 2007/0234714 | A1 * | 10/2007 | Maus | B01D 53/945 60/299 |
| 2012/0048768 | A1 * | 3/2012 | Holloway | F28D 20/021 206/524.1 |
| 2015/0021002 | A1 * | 1/2015 | Hoglund | F28F 13/12 165/133 |

FOREIGN PATENT DOCUMENTS

| | | | |
|---|---|---|---|
| EP | 0120828 | B1 | 9/1991 |
| EP | 1004370 | B1 | 1/2004 |
| EP | 1123759 | B2 | 6/2011 |
| PL | 1912898 | B1 | 3/1999 |
| PL | 193798 | B1 | 6/2000 |
| PL | 190740 | B1 | 1/2006 |
| WO | 8402179 | A1 | 6/1984 |
| WO | 0196803 | A1 | 12/2001 |
| WO | 2007078240 | A1 | 7/2007 |
| WO | 2009128750 | A1 | 10/2009 |
| WO | 2010016792 | A1 | 2/2010 |

* cited by examiner

A

HEAT TRANSMISSION ROLL FOR A ROTARY CYLINDRICAL HEAT EXCHANGER

The invention concerns a heat transmission roll for a rotary cylindrical heat exchanger. It is designated for use in rotary exchangers of various types, fitted with a system of channels parallel to the axis of rotation, especially for recuperative exchangers of the air-air type used in ventilation systems.

Known are different types of heat exchangers the structure of which depends on many factors, in particular on the function which they serve and on their location. One of the groups among various types of heat exchanger structure are rotary heat exchangers in which heat is transferred between two streams of fluids differing in temperatures through the walls of the channels in which those fluids flow, parallel to the rotation axis.

Known from patent description PL190740 is an assembly of heat transfer elements for a rotary regenerative heat exchanger comprising a plurality of plates stacked in spaced relationship thereby providing passageways for the flow of the heat exchange fluid therebetween, each of the said plates having transverse notches extending thereacross and projecting outwardly from the said plate to a peak, whereby said notches support adjacent plates in said spaced relationship. There are indentations formed in the said notches. The plates may feature undulations which may run at an angle with respect to the notches.

Known from European patent application published under number EP0052592A2 is a heat transmission roll comprising two superposed strips wound about the core, one of which is provided with transverse ridges whereas the second strip is provided with longitudinal ribs. The transverse ridges of the first strip are provided are provided with indentations having a pitch matching that of the longitudinal ribs formed in the second strip, in which indentations engage said ribs formed in the second strip.

Disclosed in European patent application EP0136515B1 is the structure of a fume catalytic converter in the form of a roll composed of spirally wound, alternating layers corrugated transversely and of basically flat metal strips non-corrugated transversely. The strip non-corrugated transversely features a structure which extends basically longitudinally, i.e. in the winding direction, where the structure takes the form of grooves the depth of which is approximately equal to the thickness of the metal strip. The structure can take the form of alternating flat troughs and ridges of approximately identical width. The adjacent metal strips are soldered together in all or selected points of contact.

The heat transmission roll for a rotary cylindrical heat exchanger according to the invention, comprising layers formed by two superposed strips wound around the core, where the first strip is corrugated transversely to form regular waves with wave crests on the one side of the strip and wave troughs on the other side of the strip, while the second strip is basically flat, is characterised by the fact that formed on all wave crests of the first strip are bulges featuring slits, where one of the slit edges is formed into a tongue. The second strip features separate indentations to accommodate the bulges on the first strip, where the depth of the indentation corresponds to the pitch of the bulge.

Preferably, the bulges are spaced equidistantly, identically on all wave crests, and form lines parallel to the strip edges.

In particularly preferable variant, the distance between the adjacent bulges on a single wave crest falls within the range from 5 to 30 times the wave pitch, and the distance between the first line of bulges and the strip edge falls within the range from 5 to 25 times the wave pitch.

Most preferably, each bulge features one slit below the top edge of the bulge and parallel to that edge.

The most preferable technical effect of the invention is achieved when the tongue is formed on the edge of the slit on the side of the bulge top and bent outside, off the bulge wall.

Preferably, the width of the bulge falls within the range from 3 to 9 times the wave pitch, and the width of the slit is 60-95% of the bulge width.

In the most preferable variant of the invention embodiment the pitch of the bulge falls within the range from 0.2 to 0.75 times the wave pitch.

The basic advantage of the solution according to the invention lies in the fact that the roll forms a self-supporting structure for heat transmission designated for rotary cylindrical heat exchangers, where the structure ensures roll stability when the heat exchanger is in operation, i.e. when it is rotating, without the need to use any additional stabilizing technical means. An additional advantage consists in the possibility to simplify the production technology of such a roll by eliminating the stage of pre-shaping one of the wound strips.

Figure 2:
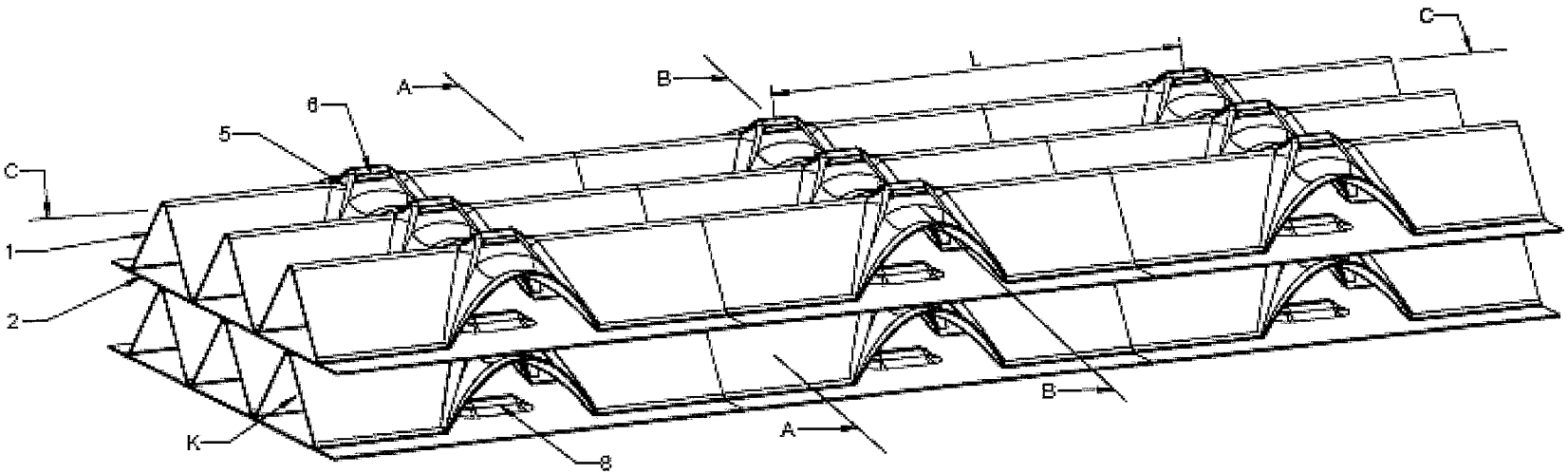
Figure 3:
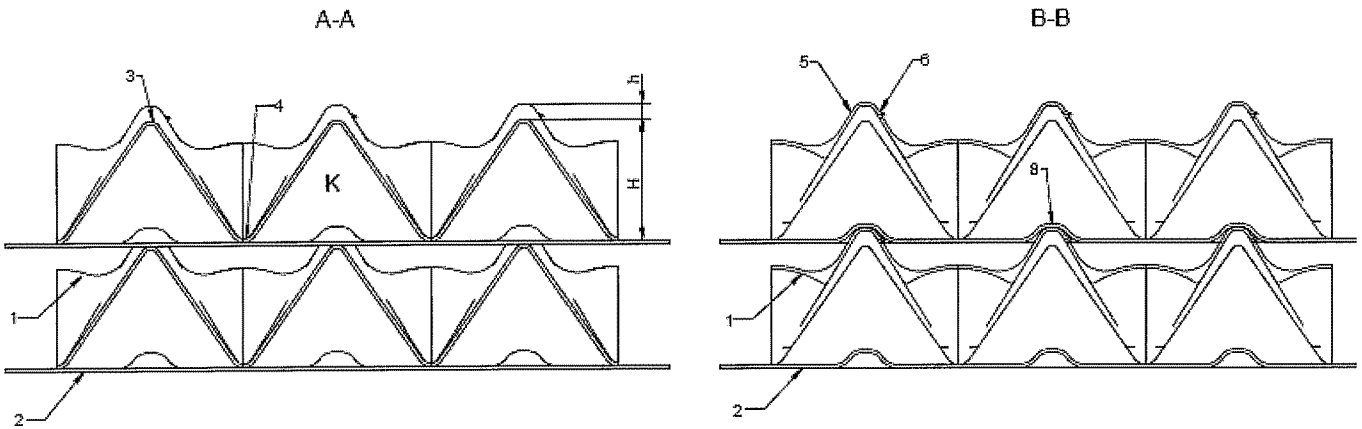
Figure 4:
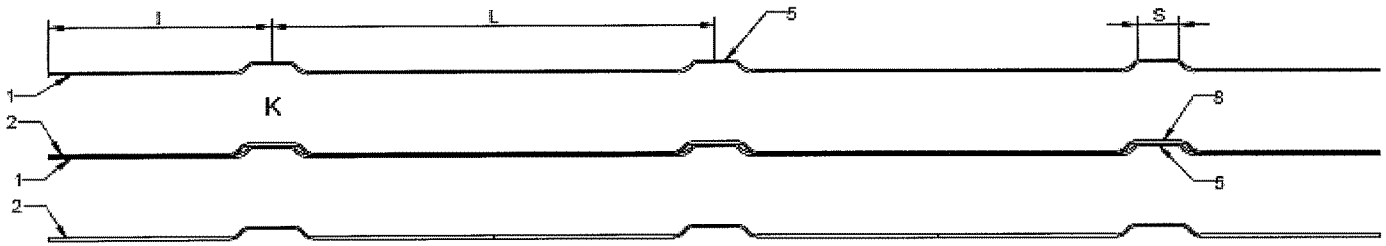
Figure 5:
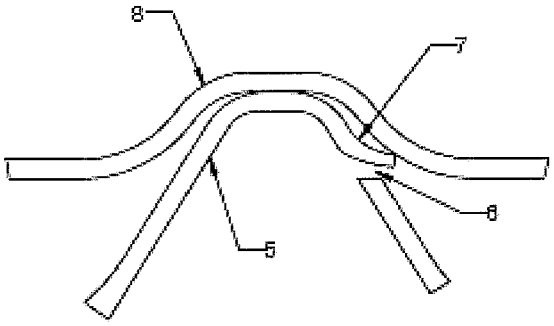

An exemplary embodiment of the heat exchange roll for a rotary heat exchanger is illustrated on a drawing where FIG. 1 shows schematically the roll and a section thereof, FIG. 2 shows the axonometric view of a fragment of four roll layers, FIG. 3 presents two cross-sections of the fragment shown on FIG. 2, FIG. 4 depicts longitudinal section of the fragment shown on FIG. 2 along the wave crest, and FIG. 5 shows a zoomed-in view of the positioning of the bulge of the first strip in the indentation of the second strip.

In the exemplary embodiment of the invention the heat transmission roll Z, the cross-section of which is shown on FIG. 1, takes the shape of a cylinder formed of two thin-walled strips made of metal, aluminum in particular, namely: the first strip 1 corrugated transversely, and the second strip 2 which is basically flat, where the two strips are superposed and wound around the core. The wound aluminum strips form subsequent layers, alternatingly flat and corrugated, with channels K running in between the layers, allowing the flow of air through the roll. When the air contacts the walls of the channels K heat exchange occurs, changing the physical parameters of the air, its temperature and humidity. In this way heat is transmitted between the air flowing in the channels and the channel walls. The roll Z together with its housing and other necessary accessories, which are not shown on the drawing, forms a heat exchanger of the air-air type, designated especially for heat recovery in ventilation systems. The air blown out of a room transmits its heat energy to the roll, cools or heats the walls of its channels, and following the rotation of the exchanger the heat energy from the walls is transmitted to the air blown into the room. Shown on FIG. 2, FIG. 3 and FIG. 4 is a fragment of the roll Z comprising two layers of the corrugated first strip 1 and two layers of the basically flat second strip 2, where in order to simplify the view and depict the shapes better the figures do not account for the curvature of the roll. The first strip 1 is corrugated transversely into waves with regularly spaced transverse wave crests 3 on the one side of the strip and with strip troughs 4 on the other side of the strip, with the inner angle of the wave profile falling within the range from 60° to 100° and with the wave pitch H ranging from 1 to 2.7 mm.

Formed on all wave crests 3 are bulges 5 in the shape of teeth. Each bulge 5 has one slit 6 in its top section, the slit parallel to the top edge of the wave crest and having the width accounting for 60%-95% of the width S of the bulge 5. The top edge of each slit 6 is shaped into a tongue 7, bent outwards off the wall of the bulge 5. In the most advantageous variant the slit 6 is cut below the top edge of the tooth forming the bulge 5 and is given the width accounting for 80% of the width S of the bulge 5. All bulges 5 are identical and spaced regularly, forming longitudinal lines running parallel to the strip edges and perpendicular to the transverse wave crests 3 of the corrugated first strip 1. The width S of each of the bulges 5 falls within the range from 3 to 9 times the wave pitch H, i.e. the distance between the wave crest 3 and the wave trough 4. The pitch h of the bulge 5, on the other hand, ranges from 0.2 to 0.75 times the wave pitch H, preferably representing 0.3 of the wave pitch H. The distance L between the adjacent bulges 5 on the wave crest 3 is selected from the range from 5 to 30 times the wave pitch H, most preferably 10×H. The distance I between the first line of bulges 5 and the strip edge falls within the range from 5 to 25 times the wave pitch H, most preferably 9×H. On the side of the wave crests 3 the corrugated first strip 1 positioned in the roll contacts one layer, and on the side of the wave troughs 4 it contacts the second layer of the second strip 2 positioned in the roll, where the strip, although basically flat, features separate small indentations 8 on its surface, where the indentations accommodate the bulges 5 of the first strip 1. The shape and spacing of the indentations 8 correspond to the shape and spacing of the bulges 5 on the wave crests 3 of the first strip 1. In this way the separate small indentations 8 in the basically flat second strip 2 form longitudinal lines parallel to the strip edge and corresponding to the longitudinal lines formed by the bulges 5 of the first strip 1. On its other side, the second strip 2 contacts the wave troughs 4 of another layer of the first strip 1 which stretches under the second strip 2. FIG. 5 schematically shows a zoomed-in view of the bulge 5 featuring the slit 6 with the tongue 7 in the indentation 8 of the second strip 2, the bulge found on the wave crest 3 of the first strip 1. In the thus-shaped roll Z formed of alternating layers of the corrugated first strip 1 and basically flat second strip 2, the bulges 5 formed on the wave crests of the first strip 1 are positioned in the indentations 8 formed in the second strip 2, and tongues 7 formed in the slits 6 of the bulges 5 rest on and catch the walls of the indentations 8, preventing the strips from undesirable shifting when the heat exchanger is in operation.

In the exemplary embodiment of the invention the first and second strips 1, 2 are made of aluminum foil 0.02 mm-0.2 mm thick and 70 mm-300 mm wide, the wave pitch H of the corrugated foil is selected from range from 1 mm to 2.7 mm, the bulge pitch h is 0.3 times the wave pitch H, and the width S of the bulge is 4 times the wave pitch H. For the corrugated and basically flat foils to be clamped together effectively, appropriate rollers are used with the compression force effected on both strips in the course of their winding, ranging from 0.1 to 0.15 bar per each 10 mm of the pressure roller width. The aluminum can additionally be covered with a moisture-absorbing agent.

The solution according to the invention ensures minimising the friction between the layers of strips in the roll and prevents loosening of the roll during operation. The fact enables achieving the structure of a heat-transmission roll for a rotary heat exchanger which does not require the use of any additional technical means such as gluing, welding, pinning, etc., to ensure roll stability when the exchanger is in operation. The means deteriorate the heat exchange parameters and constitute a technological obstacle in the production of such exchangers. This is particularly important in the case of very narrow rolls in which ensuring the rigidity and stability with additional rods placed inside the roll is technologically very difficult. Moreover, the invention makes it possible to simplify the technology of producing a stable exchanger roll, since the basically flat strip does not need to be pre-shaped on a separate stand before being wound, or precisely positioned with respect to the second corrugated strip. Thanks to the application of pressure to the contacting strips in the course of their winding the bulges on the wave crests of the corrugated strip, when it is wound together with the flat strip, press against the flat strip causing indentations therein, and the slits and tongues on the bulges keep the strips in place and clamp them together tightly.

The heat transmission roll of the structure according to the invention can serve various applications, and be made in other variant than the exemplary embodiment, but sharing its substantial features.

The invention claimed is:

1. A heat transmission roll for a rotary cylindrical heat exchanger comprising layers formed by two superposed strips wound around a core, wherein a first strip (1) is corrugated transversely to form regular waves with wave crests (3) on a one side of the first strip and wave troughs (4) on other side of the first strip, while a second strip (2) is flat, characterised in that formed on all wave crests (3) of the first strip (1) are bulges (5) featuring slits (6), where one of a slit edges is formed into a tongue (7), while the second strip (2) features separate indentations (8) to accommodate the bulges (5) on the first strip (1), where a depth of indentation corresponds to a pitch (h) of the bulge (5) wherein the tongue (7) formed on an edge of the slit (6) on a side of the top of the bulge (5) is bent outside, off a wall of the bulge (5).

2. The roll according to claim 1, characterised in that the bulges (5) are spaced in equal distances (L), identically on all wave crests (3) and form lines parallel to strip edges.

3. The roll according to claim 2, characterised in that a distance (L) between the adjacent bulges (5) on a single wave crest (3) falls within a range from 5 to 30 times a wave pitch (H), and a distance (I) between a first line of the bulges (5) and the strip edge falls within a range from 5 to 25 of the wave pitch (H).

4. The roll according to claim 3, characterized in that each bulge (5) features one slit (6) below a top edge of the bulge (5) and parallel to that edge.

5. The roll according to claim 1, characterised in that a width (S) of the bulge (5) falls within a range from 3 to 9 times a wave pitch (H), and a width of the slit (6) is 60-95% of a width (S) of the bulge (5).

6. The roll according to claim 5, characterised in that a pitch (h) of the bulge (5) falls within a range from 0.2 to 0.75 times the wave pitch (H).

* * * * *